United States Patent [19]

Nakamura

[11] Patent Number: 4,765,654

[45] Date of Patent: Aug. 23, 1988

[54] SINGLE-SHEET PRINTER PAPER AND A METHOD FOR ITS USE

[75] Inventor: Hisashi Nakamura, Fukuyama, Japan

[73] Assignee: Mitsubishi Denki Kabushiki Kaisha, Japan

[21] Appl. No.: 930,915

[22] Filed: Nov. 17, 1986

[30] Foreign Application Priority Data

Dec. 16, 1985 [JP] Japan ..... 60-284613

[51] Int. Cl.[4] ..... B42D 15/00; B42D 19/00; B41F 1/46; B41J 13/03

[52] U.S. Cl. ..... 283/67; 281/5; 101/141; 400/636

[58] Field of Search ..... 283/67; 281/5, 6; 101/132, 228, 141, 142; 400/120, 230.3, 636, 637

[56] References Cited

U.S. PATENT DOCUMENTS

| | | | |
|---|---|---|---|
| 3,370,546 | 2/1968 | Muller | 101/142 |
| 3,744,413 | 7/1973 | Wolff | 101/142 |
| 3,750,573 | 8/1973 | Haesler et al. | 101/142 |
| 4,188,881 | 2/1980 | Bruning | 101/141 |
| 4,215,945 | 8/1980 | Habich et al. | 400/636 |
| 4,477,103 | 10/1984 | Bertolazzi | 281/5 |

*Primary Examiner*—E. R. Kazenske
*Assistant Examiner*—Paul M. Heyrana, Sr.
*Attorney, Agent, or Firm*—Leydig, Voit & Mayer

[57] ABSTRACT

Single-sheet printer paper comprises a sheet of paper having a middle portion having the same dimensions as a standard-size sheet of paper, upper and lower holding portions which are integrally formed on the upper and lower edges of the middle portion, and guide lines for cutting which are formed along the borders between the middle portion and the holding portions. In a preferred embodiment, the guide lines are in the form of perforations. A method for using this paper comprises printing over the entire length of the middle portion with a printer and removing the holding portions by shearing along the guide lines so as to obtain a sheet having the same dimensions as a standard-size sheet and which is printed on over its entire length.

1 Claim, 2 Drawing Sheets

SINGLE-SHEET PRINTER PAPER AND A METHOD FOR ITS USE

BACKGROUND OF THE INVENTION

This invention relates to single-sheet paper intended for use with a printer as well as to a method of using the paper. More particularly, it relates to single-sheet paper which can be printed on over a length corresponding to the entire length of standard-size single-sheet paper.

When using conventional single-sheet paper with a conventional printer, it is impossible to print over the entire length of the paper. The reason for this will be explained by referring to FIG. 1, which is a schematic illustration of a conventional heat transfer printer. As shown in the figure, a single sheet of paper 3 is held against the platen 1 of the printer during printing by a set of upper pinch rollers 2*a* and a set of lower pinch rollers 2*b*, both of which are in rolling contact with the platen 1 when there is no paper in the printer. By the rotation of the platen 1, the paper 3 is advanced in the direction of arrow A. Characters are printed on the paper 3 at a printing postion P by means of a printing head 4 and an ink ribbon 5 which is advanced in the direction of arrow B. To prevent slippage of the paper 3 during printing so as to obtain a clear printed image, it is important that the paper 3 be simultaneously restrained by both the upper pinch rollers 2*a* and the lower pinch roller 2*b*. Thus, the first printed line on a page can be no closer to the upper edge of the page than a distance Ta, which is the distance measured along the periphery of the platen 1 of FIG. 1 from the printing position P to the upper pinch rollers 2*a*, for if the first printed line is located higher than this, the upper pinch rollers 2*a* can not restrain the upper edge of the paper. Similarly, the last printed line on the page can be no closer to the bottom edge of the page than a distance Tb, which is the distance from the printing position P to the lower pinch rollers 2*b* measured along the platen 1. As a result, there is a region 3*a* at the top of the paper 3 of height Ta and another region 3*b* at the bottom of the paper 3 of height Tb which can not be printed on (see FIG. 2), and the area of the paper 3 which can be printed on is limited to the hatched region in FIG. 2.

If it is desired to print over a region corresponding to the entire length of a sheet of standard-size paper, it is necessary to employ fan-fold paper or roll paper. However, such paper requires a completely different paper feed mechanism from single-sheet paper, and it is thus troublesome and expensive to switch from single-sheet paper to fan-fold or roll paper. There is thus a need for paper which can be printed on over a larger region than usual single sheet paper but which can be used with a conventional single-sheet paper feed mechanism.

SUMMARY OF THE INVENTION

It is an object of the present invention to meet this need and to provide single-sheet paper which can be printed on over a length corresponding to the entire length of a sheet of standard-size paper and which can be used with a conventional paper feed mechanism for conventional single-sheet paper.

It is another object of the present invention to provide a simple method for using this single-sheet paper.

Single-sheet paper according to the present invention comprises a single sheet which is divided into a middle portion having the same dimensions as a sheet of standard-size paper and upper and lower holding portions which are located above and below the middle portion at the top and bottom of the paper, respectively. The holding portions have the same width as the middle portion and a height sufficient for them to be held by the pinch rollers of a printer while printing is performed on any part of the middle portion. Guide lines for cutting off the holding portions are provided along the borders between the middle portion and the upper and lower holding portions. In a preferred embodiment, the guide lines are perforated lines which enable the holding portions to be easily removed by cutting or by tearing off by hand.

A method of using this paper comprises printing over the entire length of the middle portion with a printer, followed by removing the holding portions from the middle portion by shearing along the guide lines for cutting.

BRIEF DESCRIPTION OF THE DRAWINGS

In the figures, the same reference numerals indicate the same or corresponding parts.

DESCRIPTION OF THE PREFERRED EMBODIMENTS

Figure 3:
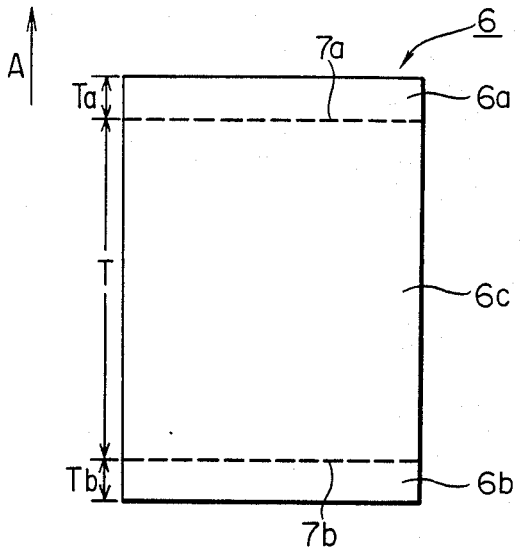
FIG. 3 is a plan view of a sheet of single-sheet paper according to the present invention.
Figure 4:
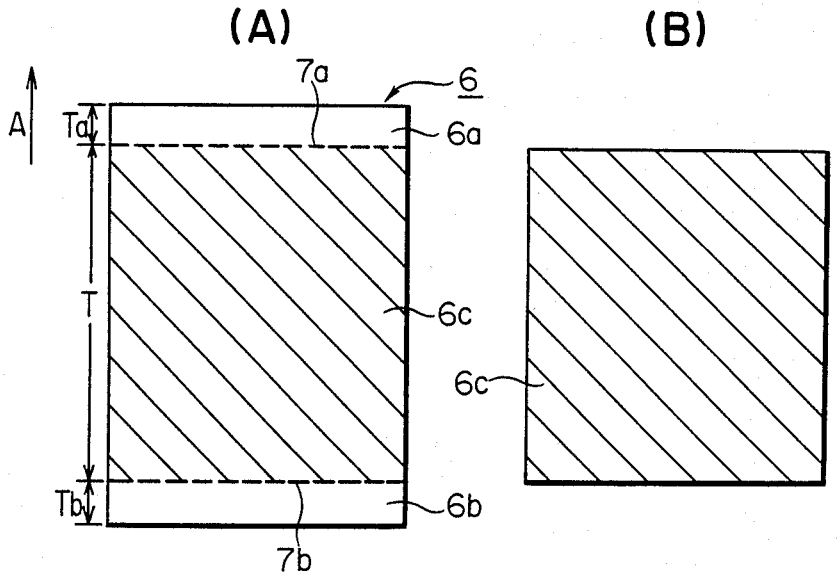
FIG. 4A is a plan view of the embodiment of FIG. 3, showing the paper after printing.
FIG. 4B is a plan view of the embodiment of FIG. 3 after the removal of the holding portions.

Hereinbelow, a preferred embodiment of the present invention will be described while referring to FIGS. 3 and 4 of the accompanying drawings. As shown in FIG. 3, which is a plan view of this embodiment, single-sheet paper 6 according to the present invention comprises a single sheet of paper which is divided into a middle portion 6*c*, an upper holding portion 6*a* which is located above the middle portion 6*c*, and a lower holding portion 6*b* which is located below the middle portion 6*c*. The middle portion 6*c* has the same dimensions as a standard-size sheet of paper such as A4-size paper, B4-size paper, or the like. The upper holding portion 6*a* has the same width as the middle portion 6*c* and a height TA corresponding to the distance from the printing position P to the upper pinch rollers 2*a* of a conventional printer like the one shown in FIG. 1. Similarly, the lower holding portion 6*b* has the same width as the middle portion 6*c* and a height Tb corresponding to the distance from the printing position P to the lower pinch rollers 2*b* of FIG. 1. Guide lines 7*a* and 7*b* for cutting are provided along the borders between the middle portion 6*c* and the upper and lower holding portions 6*a* and 6*b* respectively. In the present embodiment, the guide lines 7*a* and 7*b* are perforated lines which enable the holding portions to be easily removed from the middle portion 6*c* either by cutting or by tearing by hand along the guide lines.

Figure 1:
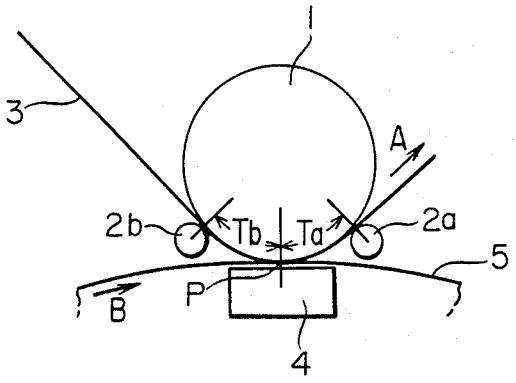
FIG. 1 PRIOR ART
FIG. 1 is a schematic illustration of a conventional heat transfer printer during printing on a sheet of conventional single-sheet paper.
Figure 2:
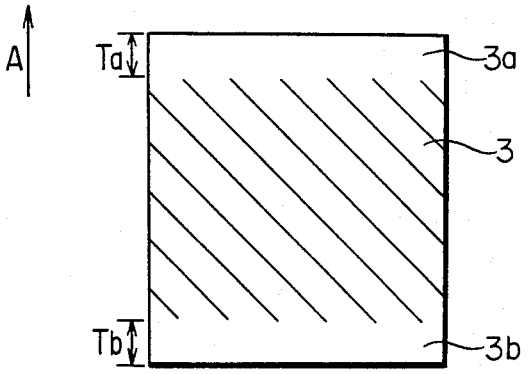
FIG. 2 PRIOR ART
FIG. 2 is a plan view of a sheet of conventional single-sheet paper.

Printing on a sheet of this single-sheet paper 6 with a printer is performed in exactly the same manner as for conventional single-sheet paper 3, using a conventional printer as shown in FIG. 1 equipped with a paper feed mechanism for usual single-sheet paper. At the beginning of printing a page, the upper holding portion 6a of the paper 6 is held against the platen 1 of the printer by the upper pinch rollers 2a, and the printer is controlled so as to begin printing at a distance Ta from the very top of the paper 6, just as with conventional paper 3. This position corresponds to the top of the middle portion 6c of the paper 6. At the end of printing a page, the lower holding portion 6b of the paper 6 is held against the platen 1 of the printer by the lower pinch rollers 2b, and the printer is controlled so as to stop printing at a distance Tb from the bottom of the paper 6. This corresponds to the bottom of the middle portion 6c. At all points between the top and the bottom of the page, the paper 6 is restrained by the upper and lower pinch rollers 2a and 2b in the same manner as is conventional paper 3 and is prevented from slipping.

After printing is completed, the paper 6 is removed from the printer and appears as shown schematically in FIG. 4A, the hatching indicating the area which is printed on. This area is the entirety of the middle portion 6c, and corresponds in size to the entirety of a sheet of standard-size single-sheet paper. The upper and lower holding portions 6a and 6b are then cut off or torn off by shearing along the guide lines 7a and 7b, respectively. What results after removing the holding portions, as shown in FIG. 4B, is a sheet of paper having the same dimensions as a sheet of standard-size single-sheet paper 3, but which is printed on over its entire length. The holding portions 6a and 6b can be simply torn off by hand or cut off with a hand tool such as scissors, but they can also be easily removed by a suitable automatic cutting mechanism.

In the above-described embodiment, the guide lines 7a and 7b for cutting off the holding portions 6a and 6b are in the form of perforated lines with elongated perforations. However, the guide lines are not limited to this type, and any type of guide line which enables the holding portions to be easily removed can be used. For example, the guide lines can be in the form of one or more rows of round perforations or in the form of folds.

Although the above embodiment was described with reference to a heat transfer printer, single-sheet paper according to the present invention can be used with any type of printer having an upper and lower set of pinch rollers for holding the paper against the platen.

What is claimed is:

1. Single-sheet printer paper for use with a printer having an upper pinch roller and a lower pinch roller disposed on both sides of a printing head for holding the paper against a platen comprising:

a single sheet of paper having guide lines for cutting and which is divided by said guide lines into a middle portion having the same dimensions as a sheet of paper of a standard size, an upper holding portion which is located above and is integral with and has the same width as said middle portion, and a lower holding portion which is located below and is integral with and has the same width as said middle portion, the height of said upper holding being equal to the distance measured along said platen from the printing position of said printing head to said upper pinch rollers, and the height of said lower holding portion being equal to the distance measured along said platen from the printing position of said printing head to said lower pinch rollers; and said guide lines for cutting being formed along the borders between said holding portions and said middle portion.

* * * * *